US006521175B1

(12) United States Patent
Mourer et al.

(10) Patent No.: US 6,521,175 B1
(45) **Date of Patent: *Feb. 18, 2003**

(54) SUPERALLOY OPTIMIZED FOR HIGH-TEMPERATURE PERFORMANCE IN HIGH-PRESSURE TURBINE DISKS

(75) Inventors: David P. Mourer, Beverly, MA (US); Eric S. Huron, West Chester, OH (US); Kenneth R. Bain, Loveland, OH (US); Enrique E. Montero, Okeechobee, FL (US); Paul L. Reynolds, Palm Beach Gardens, FL (US); John J. Schirra, Ellington, CT (US)

(73) Assignee: General Electric Co., Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/021,040

(22) Filed: Feb. 9, 1998

(51) Int. Cl.[7] ..... C22C 19/05
(52) U.S. Cl. ..... 420/448; 148/428
(58) Field of Search ..... 420/448; 148/428

(56) References Cited

U.S. PATENT DOCUMENTS

| | | | | |
|---|---|---|---|---|
| 2,712,498 A | | 7/1955 | Gresham et al. | 75/171 |
| 3,061,426 A | | 10/1962 | Bieber | 75/171 |
| 3,166,411 A | | 1/1965 | Cook et al. | 75/171 |
| 3,486,887 A | | 12/1969 | Yoda et al. | 75/171 |
| 3,785,785 A | * | 1/1974 | Hodshire et al. | 428/553 |
| 3,785,877 A | * | 1/1974 | Bailey | 148/556 |
| 3,869,284 A | * | 3/1975 | Baldwin | 148/404 |
| 4,140,555 A | * | 2/1979 | Garcia et al. | 148/404 |
| 4,769,087 A | | 9/1988 | Generaux et al. | 148/2 |
| 4,981,644 A | | 1/1991 | Chang | 420/442 |
| 5,104,614 A | | 4/1992 | Ducrocq et al. | 420/448 |
| 5,129,970 A | | 7/1992 | Henry | 148/428 |
| 5,130,089 A | | 7/1992 | Henry | 420/448 |
| 5,143,563 A | | 9/1992 | Krueger et al. | 148/410 |
| 5,171,380 A | | 12/1992 | Henry | 148/428 |
| 5,393,483 A | | 2/1995 | Chang | 419/10 |

OTHER PUBLICATIONS

Chang, M., et al.: "Damage Tolerance of P/M Turbine Disc Materials" Superalloys, XX, XX, 1996, pp. 677–685 (no month data).

* cited by examiner

*Primary Examiner*—John Sheehan
*Assistant Examiner*—Andrew L. Oltmans

(57) ABSTRACT

A superalloy has a composition of, in weight percent, from about 16.0 percent to about 22.4 percent cobalt, from about 6.6 percent to about 14.3 percent chromium, from about 1.4 percent to about 3.5 percent tantalum, from about 1.9 percent to about 4.0 percent tungsten, from about 1.9 percent to about 3.9 percent molybdenum, from about 0.03 percent to about 0.10 percent zirconium, from about 0.9 percent to about 3.0 percent niobium, from about 2.4 percent to about 4.6 percent titanium, from about 2.6 percent to about 4.8 percent aluminum, from 0 to about 2.5 percent rhenium, from about 0.02 percent to about 0.10 percent carbon, from about 0.02 percent to about 0.10 percent boron, balance nickel and minor amounts of impurities. The superalloy is advantageously utilized in aircraft gas turbine disks.

18 Claims, 2 Drawing Sheets

SUPERALLOY OPTIMIZED FOR HIGH-TEMPERATURE PERFORMANCE IN HIGH-PRESSURE TURBINE DISKS

The invention herein described was made in the course of or under contract or subcontract thereunder (or grant) with the Department of the Navy.

BACKGROUND OF THE INVENTION

This invention relates to nickel-base superalloys and, more particularly, to such a superalloy optimized for use in high-temperature components of jet engines such as turbine disks.

In an aircraft gas turbine (jet) engine, air is drawn into the front of the engine, compressed by a shaft-mounted compressor, and mixed with fuel. The mixture is burned, and the hot exhaust gases are passed through a turbine mounted on the same shaft. The turbine includes a disk portion mounted to the shaft and a series of turbine blades supported on the rim of the disk. The flow of hot exhaust gas impinges upon the turbine blades and causes the turbine disk to turn, which turns the shaft and provides power to the compressor. The hot exhaust gases flow from the back of the engine, driving it and the aircraft forwardly.

The hotter the exhaust gases, the more efficient is the operation of the jet engine. There is thus an incentive to raise the exhaust combustion gas temperature, which in turn leads to higher operating temperature requirements of many of the components from which the engine is constructed. In response to these requirements, alloys with carefully tailored, improved mechanical properties have been developed for use in the various sections of the engines.

In operation, the turbine disks encounter different operating conditions radially from the center or hub portion to the exterior or rim portion. The rim is hotter than the hub and, in general, all of the operating temperatures are higher for more advanced engines. The stress conditions also vary radially, with the lower stresses at the rim and the higher stresses at the hub. As a result of the different operating conditions, the material at the rim of the disk must exhibit good high temperature creep and stress rupture resistance as well as high-temperature strength and hold-time fatigue crack growth resistance. The hub region of the disk must exhibit high tensile strength at more moderate temperatures and resistance to low cycle fatigue crack growth. In the most common design, the entire turbine disk is made of a single forged and heat-treated piece of material. The selected alloy used in the disk must therefore meet all of the materials requirements discussed above.

The materials used in the turbine disk are also chosen in relation to the aircraft mission requirements. In general, the mission cycles of high-performance military aircraft engines require higher operating temperatures but have shorter. times at the maximum temperatures, as compared with those of civilian aircraft engines. A current goal in some military aircraft applications is a high-pressure turbine disk operable at temperatures of up to 1500° F. for relatively short periods of time.

Current nickel-base superalloys used in turbine disks, such as Rene 88DT, Rene 95, and IN 100, have an operating temperature limit of 1200–1300° F. These types of alloys cannot meet the operating temperature goal of 1500° F. for the military aircraft engines. New alloys are under development which have operating temperature limits approaching about 1400° F. under some mission cycles, but typically such alloys have high gamma-prime solvus temperatures and are accordingly difficult to process. Some have been observed to exhibit undesirable thermally induced porosity.

Thus, although satisfactory alloys are available for use in turbine disks for existing engines and there are development efforts underway for alloys with evenhigher operating temperatures, there is always a need for improved materials that are operable in applications such as aircraft turbine disks at higher temperatures of up to 1500° F., are stable, and are producible. The present invention provides such an improved material.

SUMMARY OF THE INVENTION

The present invention provides a nickel-base superalloy composition that is useful in hot-section components of aircraft gas turbine engines. The alloy is particularly useful in turbine disks for the high-pressure turbine stages of the engine that are subjected to the highest operating temperatures. The alloy is optimized for superior mechanical performance in operating cycles reaching 1500° F., and is also selected for good fabrication and producibility properties. The density of the alloy is about 0.301 pounds per cubic inch, which is acceptable and does not lead to overly high centrifugal stresses during service. Alloy phase stability and chemical stability are good, an important consideration for an alloy which is to be used at temperatures as high as 1500° F., even for relatively short times.

In accordance with the invention, a composition of matter comprises in combination, in weight percent, from about 16.0 percent to about 22.4 percent cobalt, from about 6.6 percent to about 14.3 percent chromium, from about 1.4 percent to about 3.5 percent tantalum, from about 1.9 percent to about 4.0 percent tungsten, from about 1.9 percent to about 3.9 percent molybdenum, from about 0.03 percent to about 0.10 percent zirconium, from about 0.9 percent to about 3.0 percent niobium, from about 2.4 percent to about 4.6 percent titanium, from about 2.6 percent to about 4.8 percent aluminum, from 0 to about 2.5 percent rhenium, from about 0.02 percent to about 0.10 percent carbon, from about 0.02 percent to about 0.10 percent boron, balance nickel and minor amounts of impurities. Optionally, the following elements may also be present: from 0 to about 2 percent vanadium, from 0 to about 2 percent iron, from 0 to about 2 percent hafnium, and from 0 to about 0.1 percent magnesium.

A preferred composition comprises from about 16.0 percent to about 20.2 percent cobalt, from about 6.6 percent to about 12.5 percent chromium, from about 1.5 percent to about 3.5 percent tantalum, from about 2.0 percent to about 4.0 percent tungsten, from about 1.9 percent to about 3.9 percent molybdenum, from about 0.04 percent to about 0.06 percent zirconium, from about 1.0 percent to about 3.0 percent niobium, from about 2.6 percent to about 4.6 percent titanium, from about 2.6 percent to about 4.6 percent aluminum, from 0 to about 2.5 percent rhenium, from about 0.02 percent to about 0.04 percent carbon, from about 0.02 percent to about 0.04 percent boron, balance nickel and minor amounts of impurities.

These alloys and their most preferred embodiments are carefully optimized for excellent creep performance in turbine disks operating at temperatures approaching 1500° F. Dwell fatigue crack growth performance is good, and in some cases excellent, but the primary emphasis is on obtaining the good creep performance required in this operating temperature range. The dwell fatigue crack growth performance is relatively less important than creep performance because of the relatively shorter operating times spent at the maximum elevated temperature in high-performance military engines as compared with civilian engines, for example. Some low-temperature dwell fatigue crack growth performance is therefore intentionally sacrificed in the optimized alloy of the invention to achieve further improved creep performance. The present alloys also achieve a reduced gamma-prime solvus temperature that provides a wider temperature range for heat treatments between the gamma-prime solvus and the solidus temperatures. This wider temperature range improves the processibility of the alloy. The grain boundary elements aid in the retention of a desired grain size.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
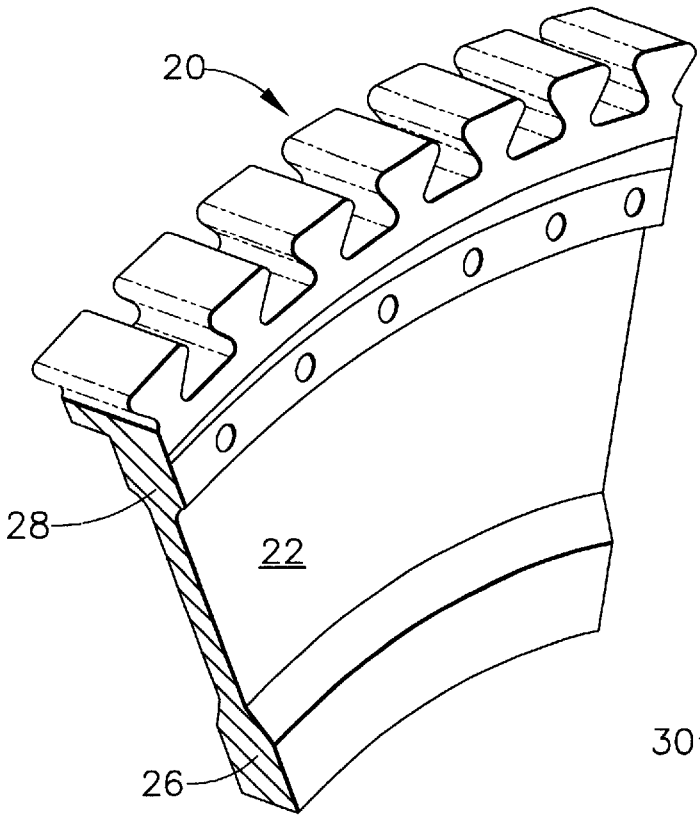
FIG. 1 is a perspective view of a gas turbine disk.

FIG. 1 depicts a turbine disk assembly 20 for use in an aircraft gas turbine engine. The assembly 20 includes a turbine disk 22 mounted to a shaft (not shown). The turbine disk 22 includes a hub section 26 near the center and a rim 28 near the periphery of the disk 22. A series of radially outwardly extending turbine blades (not shown) extend outwardly from slots 29 in the rim 28. The alloys of the present invention are particularly useful in manufacturing the turbine disk 22, while the turbine blades and the shaft are made of other materials.

Figure 2:
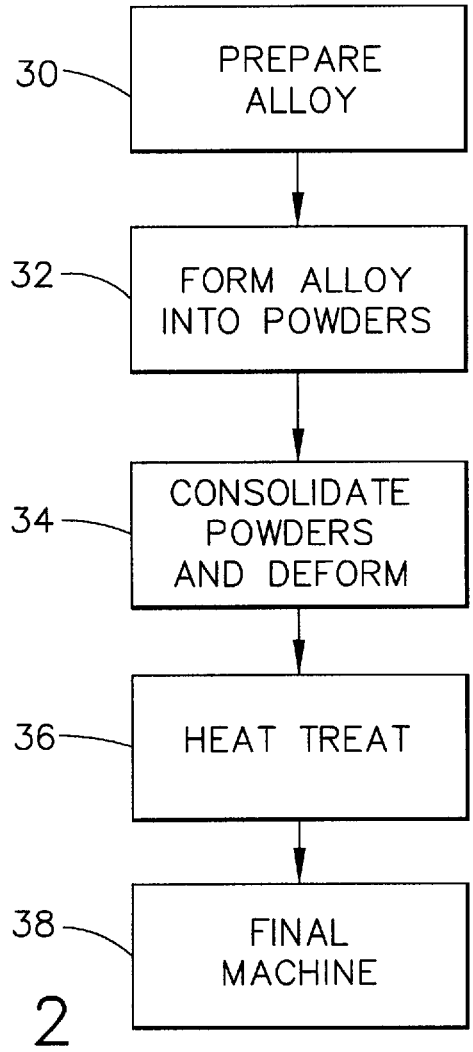
FIG. 2 is a block flow diagram of one approach to the preparation of articles using the superalloy of the invention.

FIG. 2 depicts a preferred approach of the invention for preparing articles such as the turbine disk 22.

An alloy is prepared, numeral 30. The alloy of the invention comprises in combination, in weight percent, from about 16.0 percent to about 22.4 percent cobalt, from about 6.6 percent to about 14.3 percent chromium, from about 1.4 percent to about 3.5 percent tantalum, from about 1.9 percent to about 4.0 percent tungsten, from about 1.9 percent to about 3.9 percent molybdenum, from about 0.03 percent to about 0.10 percent zirconium, from about 0.9 percent to about 3.0 percent niobium, from about 2.4 percent to about 4.6 percent titanium, from about 2.6 percent to about 4.8 percent aluminum, from 0 to about 2.5 percent rhenium, from about 0.02 percent to about 0.10 percent carbon, from about 0.02 percent to about 0.10 percent boron, balance nickel and minor amounts of impurities. All alloy compositions stated herein are in weight percent, unless specified to the contrary.

Upon proper heat treating, this alloy exhibits a microstructure of ordered gamma-prime precipitates in a gamma solid solution matrix, plus minor amounts of other phases such as borides and carbides. The composition is therefore optimized for this microstructure, its performance, especially in creep with acceptable dwell crack growth, and its producibility.

The types and amounts of the elements in the alloy composition are chosen in cooperation with each other to achieve the desired properties, based upon testing and the analysis undertaken by the inventors. Due to the interaction between the elements, the experimental compositions defined the trends for alloying, but only limited ranges of alloy compositions exhibit the final effects of compositional influences, microstructures, and resulting properties. Together the alloying trends and the absolute elemental levels define the preferred ranges of compositions. The effects of individual elements and the results of their amounts in the alloys falling outside the indicated ranges may be summarized as follows.

The cobalt content of the alloy is from about 16.0 percent to about 22.4 percent, most preferably from about 16.0 percent to about 20.2 percent. Increasing amounts of cobalt, a solid solution element, lower the gamma prime solvus temperature, a desirable result in order to widen the window of processing temperatures between the gamma-prime solvus and the solidus temperature. If the cobalt content is substantially lower than these amounts, the gamma-prime solvus temperature is too high for practical producibility, and there is a risk of incipient melting or thermally induced porosity. If the cobalt content is substantially higher than these amounts, there is an increased elemental cost of,the article and a loss in high-temperature creep capability.

The chromium content of the alloy is from about 6.6 percent to about 14.3 percent, most preferably from about 6.6 percent to about 12.5 percent chromium. Chromium is primarily a solid solution strengthening element, but can also form secondary carbides such as $M_{23}C_6$ carbides. Chromium also contributes to improved oxidation resistance, corrosion resistance, and fatigue crack growth resistance. If the chromium content is substantially lower than these amounts, the fatigue crack growth rate is increased and environmental resistance may suffer. If the chromium content is substantially higher than these amounts, the creep resistance of the alloy at elevated temperatures is reduced and there may be a tendency for alloy, chemical, or phase instability. The creep resistance of this alloy system is optimized for performance in turbine disks operating up to 1500° F., and therefore it is particularly important that the chromium content not be too high.

The tantalum content of the alloy is from about 1.4 percent to about 3.5 percent, most preferably from about 1.5 to about 3.5 percent. Tantalum, whose presence and percentage content is important to the beneficial results obtained for the alloys of the invention, primarily enters the gamma-prime phase and has the effect of improving the stability of the gamma-prime phase and improving the creep resistance and fatigue crack growth resistance of the alloy. If the tantalum content is substantially lower than these amounts, the creep life of the alloy is reduced and the dwell fatigue crack growth resistance is insufficient. Increasing the tantalum substantially above the indicated amounts has the undesirable effect of raising the gamma-prime solvus temperature so as to reduce the processibility of the alloy and increase its density.

The tungsten content of the alloy is from about 1.9 percent to about 4.0 percent, most preferably from about 2.0 percent to about 4.0 percent. Tungsten enters the matrix as a solid-solution strengthening element, and also aids in forming gamma prime precipitates. If the tungsten content is substantially lower than these amounts, the crack growth rate in fatigue is reduced but the creep rate is increased. Maintaining a relatively high tungsten content aids in achieving good creep resistance at elevated temperature. If the tungsten content is substantially higher than these amounts, microstructural instability may result, ductility may be reduced, and the density of the alloy is excessively high.

The molybdenum content of the alloy is from about 1.9 to about 3.9 percent. Molybdenum is a less-expensive, lighter-weight substitute for tungsten, but it is not as effective in solid-solution strengthening as tungsten. If the molybdenum content is less than the amount indicated, the creep resistance of the alloy becomes too low. If the molybdenum content substantially exceeds that indicated, alloy stability is reduced and the alloy density is increased above the desired level.

The zirconium content of the alloy is from about 0.03 percent to about 0.10 percent, most preferably from about 0.04 percent to about 0.06 percent. The presence of zirconium in controlled small amounts improves the elongation and ductility of the alloy, and also reduces the crack growth rate.

The niobium content of the alloy is from about 0.9 percent to about 3.0 percent, most preferably from about 1.0 percent to about 3.0 percent. Increasing amounts of niobium have a weak effect in improving creep behavior. If the niobium content is substantially below that indicated, creep properties suffer. Niobium substantially in excess of the indicated amounts tends to raise the gamma-prime solvus, adversely affecting the processibility of the alloy. Excessive niobium also raises the density of the alloy, reduces ductility, increases the tendency to chemical instability, and reduces dwell fatigue crack growth capability.

The titanium and aluminum contents are paired so as to be approximately the same in forming the $Ni_3(Al, Ti)$ gamma prime phase. The titanium content is from about 2.4 percent to about 4.6 percent, most preferably from about 2.6 percent to about 4.6 percent. The aluminum content is from about 2.6 percent to about 4.8 percent, most preferably from about 2.6 percent to about 4.6 percent. If the titanium and aluminum are present in amounts substantially lower than that indicated, the volume fraction of the gamma prime phase is reduced to an unacceptably low level. If they are present in substantially larger amounts than that indicated, they tend to increase the gamma-prime solvus temperature by an unacceptable amount, reducing the range of temperatures for successful heat treating.

The rhenium content is from 0 to about 2.5 percent, most preferably 0 or near to 0. The rhenium has little effect in the alloy of the invention, although there may be a slight beneficial effect on creep performance in the amounts indicated. Substantially higher amounts than indicated lead to an increase in the gamma-prime solvus temperature, as well as higher density and higher cost.

The carbon content is from about 0.02 percent to about 0.10 percent, most preferably from about 0.02 percent to about 0.04 percent. The carbon forms carbides with various of the other elements. Increasing amounts of carbon within the indicated ranges aid in controlling grain size of the alloy during elevated temperature exposure. However, carbon in an amount substantially greater than that indicated leads to higher fatigue crack growth rates and is accordingly undesirable.

The boron content is from about 0.02 percent to about 0.010 percent, most preferably from about 0.02 percent to about 0.04 percent, and most preferably about 0.030 percent. The boron forms borides with various of the other elements. If the boron content is substantially lower than the indicated amounts, the dwell fatigue crack growth rate tends to be increased. If the boron content is substantially higher than the indicated amounts, there is observed a tendency to incipient melting during processing and a degree of porosity in the alloy that leads to reduced creep performance.

Several other elements may optionally be added in limited amounts without adversely affecting the properties of the resulting composition. For example, magnesium in an amount up to about 0.1 percent by weight, vanadium in an amount up to about 2 percent by weight, iron in an amount up to about 2 percent by weight, and hafnium in an amount up to about 2 percent by weight may be present without adversely affecting the properties. The hafnium may improve the dwell fatigue crack growth rate but with a slight negative effect on low cycle fatigue properties.

The remainder of the alloy, totaling 100 weight percent, is nickel and minor amounts of impurities that are usually present in nickel-base alloys as a result of their presence in the original constituents or are introduced during the melting and fabrication operation. The character and minor amounts of such impurities do not adversely affect the advantages attained with the present invention.

During the course of the studies leading to the present invention, three compositions have been identified as particularly desirable. A most preferred alloy has from about 16.0 percent to about 20.0 percent cobalt, from about 8.5 percent to about 12.5 percent chromium, from about 1.5 percent to about 3.5 percent tantalum, from about 2.0 percent to about 4.0 percent tungsten, from about 1.9 percent to about 3.9 percent molybdenum, from about 0.04 percent to about 0.06 percent zirconium, from about 1.0 percent to about 3.0 percent niobium, from about 2.6 percent to about 4.6 percent titanium, from about 2.6 percent to about 4.6 percent aluminum, from about 0.02 percent to about 0.04 percent carbon, from about 0.02 percent to about 0.04 percent boron, balance nickel and minor amounts of impurities. A preferred alloy within this range, termed NF3, has a composition of about 18.0 percent cobalt, about 10.5 percent chromium, about 2.5 percent tantalum, about 3.0 percent tungsten, about 2.9 percent molybdenum, about 0.050 percent zirconium, about 2.0 percent niobium, about 3.6 percent titanium, about 3.6 percent aluminum, about 0.030 percent carbon, about 0.030 percent boron, balance nickel and minor amounts of impurities.

A second preferred alloy, but less preferred than the most preferred alloy, has from about 18.4 percent to about 22.4 percent cobalt, from about 10.3 percent to about 14.3 percent chromium, from about 1.4 percent to about 3.4 percent tantalum, from about 2.0 percent to about 4.0 percent tungsten, from about 1.9 percent to about 3.9 percent molybdenum, from about 0.03 percent to about 0.05 percent zirconium, from about 1.0 percent to about 3.0 percent niobium, from about 2.4 percent to about 4.4 percent titanium, from about 2.8 percent to about 4.8 percent aluminum, from about 0.02 percent to about 0.04 percent carbon, from about 0.02 percent to about 0.04 percent boron, balance nickel and minor amounts of impurities. A preferred alloy within this range, termed NF2, has a composition of about 20.4 percent cobalt, about 12.3 percent chromium, about 2.4 percent tantalum, about 2.9 percent tungsten, about 2.9 percent molybdenum, about 0.038 percent zirconium, about 1.9 percent niobium, about 3.4 percent titanium, about 3.8 percent aluminum, about 0.032 percent carbon, about 0.029 percent boron, balance nickel and minor amounts of impurities.

A third preferred alloy, but less preferred than either of the other two preferred alloys, has from about 16.2 percent to about 20.2 percent cobalt, from about 6.6 percent to about 10.6 percent chromium, from about 1.5 percent to about 3.5 percent tantalum, from about 2.0 percent to about 4.0 percent tungsten, from about 1.9 percent to about 3.9 percent molybdenum, from about 0.04 percent to about 0.06 percent zirconium, from about 1.0 percent to about 3.0 percent niobium, from about 2.6 percent to about 4.6 percent titanium, from about 2.6 percent to about 4.6 percent aluminum, from about 0.02 percent to about 0.04 percent carbon, from about 0.02 percent to about 0.04 percent boron, balance nickel and minor amounts of impurities. A preferred alloy within this range, termed NF1, has a composition of about 18.2 percent cobalt, about 8.6 percent chromium, about 2.5 percent tantalum, about 3 percent tungsten, about 2.9 percent molybdenum, about 0.052 percent zirconium, about 2 percent niobium, about 3.6 percent titanium, about 3.6 percent aluminum, about 0.032 percent carbon, about 0.03 percent boron, balance nickel and minor amounts of impurities.

The advantageous results attained with the present compositions are a result of the selection of the combination of elements, not any one element in isolation. The more preferred and most preferred compositions yield progressively improved results than the broad composition within the operable range, but it is also possible to attain improved results by combining the narrowed composition ranges of some elements producing improved results with the broader composition ranges of other elements.

Continuing with the procedure set forth in FIG. 2, the alloy composition is formed into a powder, numeral 32, by any operable technique. Gas atomization or vacuum atomization is preferred. The powder particles are preferably finer than -60 mesh, and most preferably -140 mesh or -270 mesh.

The powder is consolidated to a billet or forging preform shape and then subsequently deformed to a final shape, numeral 34. The preferred approach to consolidation is extrusion processing at an extrusion temperature of from about 1850° F. to about 2025° F., and a 3:1 to 6:1 extrusion ratio. After consolidation to a billet or forging preform shape, the alloy is deformed to a shaped contour oversize to, but approximating the outline of, the final part. The deformation step is preferably accomplished by isothermal forging in a strain controlled mode.

The consolidation, deformation, and a subsequent supersolvus solution heat treatment are preferably selected to yield a grain size of from about ASTM 2 to about ASTM 8, preferably from about ASTM 2 to about ASTM 5. For less demanding applications, the consolidation, deformation, and a subsequent subsolvus solution heat treatment are selected to yield a grain size of from about ASTM 9 to about ASTM 12, preferably from about ASTM 10 to about ASTM 12.

The extruded article is heat treated, numeral 36, to produce the desired microstructure. In a preferred heat treating approach, the article is solution heat treated by heating to a supersolvus temperature, such as from about 2100° F. to about 2225° F. for a period of time sufficient that the entire article reaches this temperature range. The solution-treated article is quenched to room temperature by a fan air cool, optionally followed by an oil quench. The solution-treated-and-quenched article is then aged by reheating to a temperature below the solvus temperature, preferably from about 1350° F. to about 1500° F., for a time of about 8 hours. Optionally, the article may be stress relieved by heating it to a stress-relieving temperature of from about 1500° F. to about 1800° F., most preferably about 1550° F. for 4 hours, either after the quenching step and before the aging step, or after the final age step.

In an alternative heat treatment, the article is solution treated at a partial subsolvus solution-treating temperature of from about 2000° F. to about 2100° F., quenched as described above, and aged, or stress relieved and aged, as described above.

In yet another approach to the heat treatment, the article is slow cooled from a supersolvus solution temperature at rates of less than 500° F. per hour to a subsolvus temperature. The article is then quenched as described above and aged, or stress relieved and aged, as described above.

Alternative operable procedures may be used. For example, spray forming may be employed instead of atomization to produce the metal powder. Roll forming may be employed prior to heat treating instead of isothermal forging.

Figure 3:
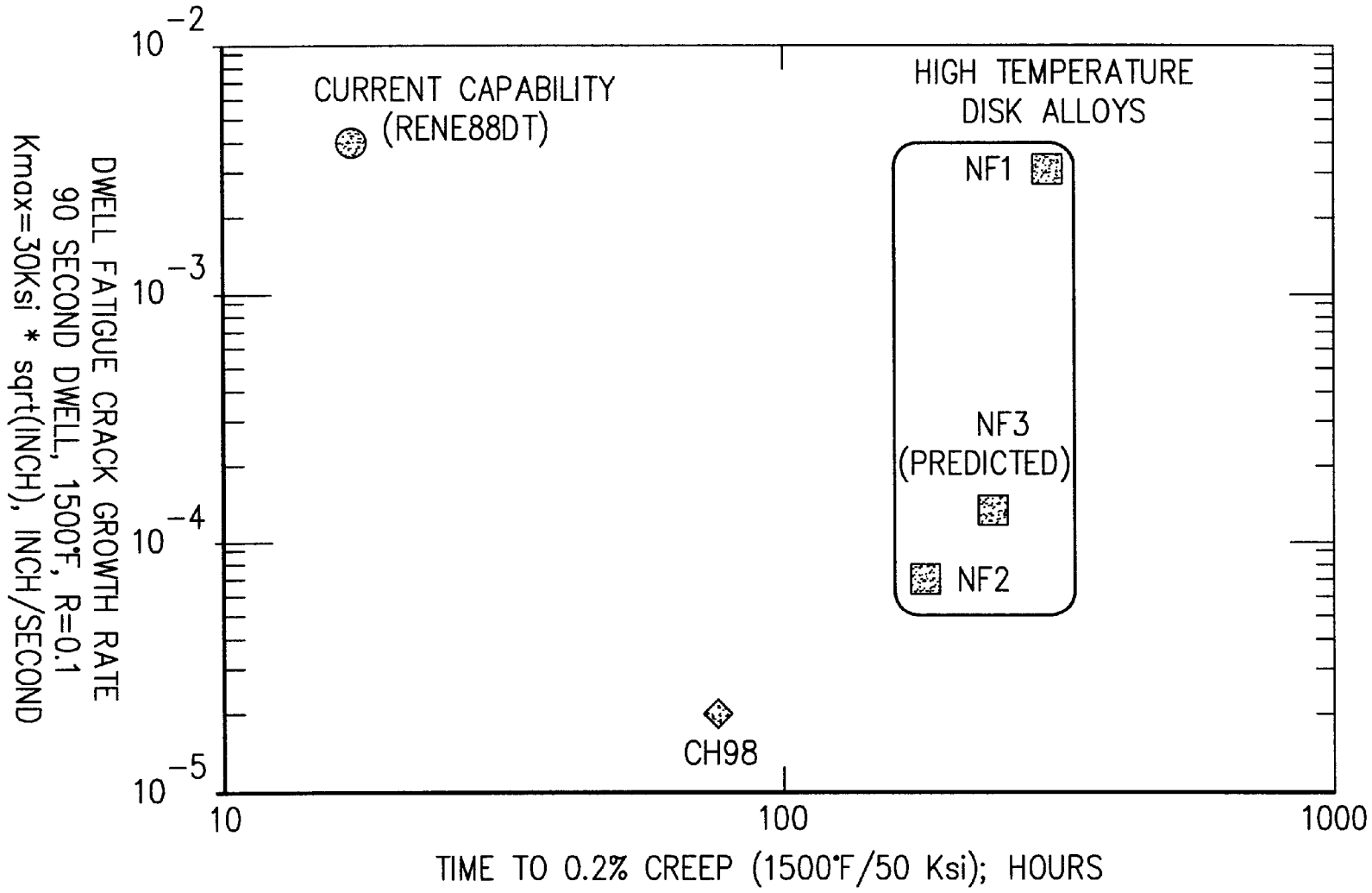
FIG. 3 is a graph of dwell fatigue crack growth rate as a function of time to creep 0.2 percent.

Specimens within the scope of the invention and comparison specimens were prepared by the preferred approach. These specimens were used to develop the data of FIG. 3. FIG. 3 illustrates data for dwell fatigue crack growth rates, performed at a temperature of 1500° F., with a ratio R of minimum to maximum stress during fatigue of 0.1, a maximum stress intensity $K_{max}$ of 30 KSI $(\text{inch})^{1/2}$, and a dwell period of 90 seconds between a reduction in stress to the minimum stress and reloading to the maximum stress. FIG. 3 also illustrates creep data for the time for reach 0.2 percent creep when measured at 1500° F. and a stress of 50,000 pounds per square inch.

It is important for applications such as turbine disks that good performance be achieved for both the dwell fatigue crack growth and for creep. For the present alloy system optimized for performance in relatively short-time engine cycles approaching temperatures of about 1500° F., achieving high creep resistance with acceptable dwell fatigue crack growth performance is the primary objective.

Composition NF1 achieves the best creep performance. Composition NF2 achieves the best dwell fatigue crack growth performance. Composition NF3 is designed to have creep performance nearly as good as that of composition NF1 and dwell fatigue crack growth performance nearly as good as that of composition NF2, and is therefore most preferred as of the present time. The choice of alloy for an application would depend, however, upon specific engine cycles and temperatures.

The compositions of the present invention achieve significantly improved dwell fatigue crack growth rates and improved creep times, as compared with conventional alloys. In FIG. 3, comparative data is presented for Rene 88DT, a standard disk alloy, and for alloy CH98, the preferred composition disclosed in U.S. Pat. No. 5,662,749. The NF1, NF2, and NF3 alloys of the present invention achieve an improvement over Rene 88DT in dwell fatigue crack growth rate and an improvement over Rene 88DT in creep life. The present alloys are not quite as good as alloy CH98 in dwell fatigue crack growth rate, but their creep performance is about four times better. As noted earlier, the present alloys were intentionally optimized for creep performance with acceptable dwell fatigue crack growth performance, for use in turbine disks in engines operating at high temperatures for relatively short times.

This invention has been described in connection with specific embodiments and examples. However, those skilled in the art will recognize various modifications and variations of which the present invention is capable without departing from its scope as represented by the appended claims.

What is claimed is:

1. A composition of matter, comprising in combination, in weight percent, from about 16.0 percent to about 22.4 percent cobalt, from about 6.6 percent to about 14.3 percent chromium, from about 1.4 percent to about 3.5 percent tantalum, from about 1.9 percent to about 4.0 percent tungsten, from about 1.9 percent to about 3.9 percent molybdenum, from about 0.03 percent to about 0.10 percent zirconium, from about 0.9 percent to about 3.0 percent niobium, from about 2.4 percent to about 4.6 percent titanium, from about 2.6 percent to about 4.8 percent aluminum, from 0 to about 2.5 percent rhenium, from about 0.02 percent to about 0.10 percent carbon, from about 0.02 percent to about 0.10 percent boron, at least one additional element selected from the group consisting of from 0 to about 2 percent vanadium, from 0 to about 2 percent iron, from 0 to about 2 percent hafnium, and from 0 to about 0.1 percent magnesium, balance nickel and minor amounts of impurities.

2. The composition of matter of claim 1, wherein the composition of matter comprises from about 16.0 percent to about 20.2 percent cobalt, from about 6.6 percent to about 12.5 percent chromium, from about 1.5 percent to about 3.5 percent tantalum, from about 2.0 percent to about 4.0 percent tungsten, from about 1.9 percent to about 3.9 percent molybdenum, from about 0.04 percent to about 0.06 percent zirconium, from about 1.0 percent to about 3.0 percent niobium, from about 2.6 percent to about 4.6 percent titanium, from about 2.6 percent to about 4.6 percent aluminum, from 0 to about 2.5 percent rhenium, from about 0.02 percent to about 0.04 percent carbon, from about 0.02 percent to about 0.04 percent boron, balance nickel and minor amounts of impurities.

3. The composition of matter of claim 1, wherein the composition of matter comprises from about 16.2 percent to about 20.2 percent cobalt, from about 6.6 percent to about 10.6 percent chromium, from about 1.5 percent to about 3.5 percent tantalum, from about 2.0 percent to about 4.0 percent tungsten, from about 1.9 percent to about 3.9 percent molybdenum, from about 0.04 percent to about 0.06 percent zirconium, from about 1.0 percent to about 3.0 percent niobium, from about 2.6 percent to about 4.6 percent titanium, from about 2.6 percent to about 4.6 percent aluminum, from about 0.02 percent to about 0.04 percent carbon, from about 0.02 percent to about 0.04 percent boron, balance nickel and minor amounts of impurities.

4. The composition of matter of claim 1, wherein the composition of matter consists essentially of about 18.2 percent cobalt, about 8.6 percent chromium, about 2.5 percent tantalum, about 3 percent tungsten, about 2.9 percent molybdenum, about 0.052 percent zirconium, about 2 percent niobium, about 3.6 percent titanium about 3.6 percent aluminum, about 0.032 percent carbon, about 0.03 percent boron, balance nickel and minor amounts of impurities.

5. The composition of matter of claim 1, wherein the composition of matter consists essentially of about 20.4 percent cobalt, about 12.3 percent chromium, about 2.4 percent tantalum, about 2.9 percent tungsten, about 2.9 percent molybdenum, about 0.038 percent zirconium, about 1.9 percent niobium, about 3.4 percent titanium, about 3.8 percent aluminum, about 0.032 percent carbon, about 0.029 percent boron, balance nickel and minor amounts of impurities.

6. The composition of matter of claim 1, wherein the composition of matter comprises from about 16.0 percent to about 20.0 percent cobalt, from about 8.5 percent to about 12.5 percent chromium, from about 1.5 percent to about 3.5 percent tantalum, from about 2.0 percent to about 4.0 percent tungsten, from about 1.9 percent to about 3.9 percent molybdenum, from about 0.04 percent to about 0.06 percent zirconium, from about 1.0 percent to about 3.0 percent niobium, from about 2.6 percent to about 4.6 percent titanium, from about 2.6 percent to about 4.6 percent aluminum, from about 0.02 percent to about 0.04 percent carbon, from about 0.02 percent to about 0.04 percent boron, balance nickel and minor amounts of impurities.

7. The composition of matter of claim 1, wherein the composition of matter consists essentially of about 18.0 percent cobalt, about 10.5 percent chromium, about 2.5 percent tantalum, about 3.0 percent tungsten, about 2.9 percent molybdenum, about 0.050 percent zirconium, about 2.0 percent niobium, about 3.6 percent titanium, about 3.6 percent aluminum, about 0.030 percent carbon, about 0.030 percent boron, balance nickel and minor amounts of impurities.

8. A composition of matter, comprising in combination, in weight percent from about 18.4 percent to about 22.4 percent cobalt, from about 10.3 percent to about 14.3 percent chromium, from about 1.4 percent to about 3.4 percent tantalum, from about 2.0 percent to about 4.0 percent tungsten, from about 1.9 percent to about 3.9 percent molybdenum, from about 0.03 percent to about 0.05 percent zirconium, from about 1.0 percent to about 3.0 percent niobium, from about 2.4 percent to about 4.4 percent titanium, from about 2.8 percent to about 4.8 percent aluminum, from 0 to about 2.5 percent rhenium, from about 0.02 percent to about 0.04 percent carbon, from about 0.02 percent to about 0.04 percent boron, balance nickel and minor amounts of impurities.

9. A nickel-base superalloy article having a composition comprising in combination, in weight percent, from about 16.0 percent to about 22.4 percent cobalt, from about 6.6 percent to about 14.3 percent chromium, from about 1.4 percent to about 3.5 percent tantalum, from about 1.9 to about 4.0 percent tungsten, from about 1.9 percent to about 3.9 percent molybdenum, from about 0.03 percent to about 0.10 percent zircinium, from about 0.9 percent to about 3.0 percent niobium, from about 2.4 percent to about 4.6 percent titanium, from about 2.6 percent to about 4.8 percent aluminum, from 0 to about 2.5 percent rhenium, from about 0.02 percent to about 0.10 percent carbon, from about 0.02 percent to about 0.10 percent boron, balance nickel and minor amounts of impurities, wherein the article has a grain size of from about ASTM 2 to about ASTM 8.

10. The article of claim 9, wherein the article is an aircraft gas turbine disk.

11. The article of claim 9, wherein the article has a composition of from about 16.0 percent to about 22.4 percent cobalt, from about 6.6 percent to about 14.3 percent chromium, from about 1.5 percent to about 3.5 percent tantalum, from about 2.0 percent to about 4.0 percent tungsten, from about 1.9 percent to about 3.9 percent molybdenum, from about 0.04 percent to about 0.06 percent zirconium, from about 1.0 percent to about 3.0 percent niobium, from about 2.6 percent to about 4.6 percent titanium, from about 2.6 percent to about 4.6 percent aluminum, from 0 to about 2.5 percent rbenium, from about 0.02 percent to about 0.04 percent carbon, from about 0.02 percent to about 0.04 percent boron, balance nickel and minor amounts of impurities.

12. The article of claim 9, wherein the article has a composition of from about 18.4 percent to about 22.4 percent cobalt, from about 10.3 percent to about 14 percent chromium, from about 1.5 percent to about 3.4 percent tantalum, from about 1.9 percent to about 4.0 percent tungsten, from about 1.9 percent to about 3.9 percent molybdenum, from about 0.04 percent to about 0.06 percent zirconium, from about 0.9 percent to about 3.0 percent niobium, from about 2.6 percent to about 4.4 percent titanium, from about 2.6 percent to about 4.6 percent aluminum, from about 0.02 percent to about 0.10 percent carbon, from about 0.02 percent to about 0.04 percent boron, balance nickel and minor amounts of impurities.

13. A nickel-base superalloy article having a composition comprising in combination, in weight percent, from about 16.0 percent to about 22.4 percent cobalt from about 6.6 percent to about 14.3 percent chromium, from about 1.4 percent to about 3.5 percent tantalum, from about 1.9 to about 4.0 percent tungsten, from about 1.9 percent to about 3.9 percent molybdenum, from about 0.03 percent to about 0.10 percent zirconium, from about 0.9 percent to about 3.0 percent niobium, from about 2.4 percent to about 4.6 percent titanium, from about 2.6 percent to about 4.8 percent aluminum, from 0 to about 2.5 percent rhenium, from about 0.02 percent to about 0.10 percent carbon, from about 0.02 percent to about 0.10 percent boron, balance nickel and minor amounts of impurities, wherein the article has a grain size of from about ASTM 9 to about ASTM 12.

14. The article of claim 13, wherein the article is an aircraft gas turbine disk.

15. The article of claim 13, wherein the article has a composition of from about 16.0 percent to about 22.4 percent cobalt, from about 6.6 percent to about 14.3 percent chromium, from about 1.5 percent to about 3.5 percent tantalum, from about 2.0 percent to about 4.0 percent tungsten, from about 1.9 percent to about 3.9 percent molybdenum, from about 0.04 percent to about 0.06 percent zirconium, from about 1.0 percent to about 3.0 percent niobium, from about 2.6 percent to about 4.6 percent titanium, from about 2.6 percent to about 4.6 percent aluminum, from 0 to about 2.5 percent rhenium, from about 0.02 percent to about 0.04 percent carbon, from about 0.02 percent to about 0.04 percent boron, balance nickel and minor amounts of impurities.

16. The article of claim 13, wherein the article has a composition of from about 18.4 percent to about 22.4 percent cobalt, from about 10.3 percent to about 14 percent chromium, from about 1.5 percent to about 3.4 percent tantalum, from about 1.9 percent to about 4.0 percent tungsten, from about 1.9 percent to about 3.9 percent molybdenum, from about 0.04 percent to about 0.06 percent zirconium, from about 0.9 percent to about 3.0 percent niobium, from about 2.6 percent to about 4.4 percent titanium, from about 2.6 percent to about 4.6 percent aluminum, from about 0.02 percent to about 0.10 percent carbon, from about 0.02 percent to about 0.04 percent boron, balance nickel and minor amounts of impurities.

17. A composition of matter, consisting essentially of, in weight percent, from about 18.4 percent to about 22.4 percent cobalt, from about 10.3 percent to about 14 percent chromium, from about 1.5 percent to about 3.4 percent tantalum, from about 1.9 percent to about 4.0 percent tungsten, from about 1.9 percent to about 3.9 percent molybdenum, from about 0.04 percent to about 0.06 percent zirconium, from about 0.9 percent to about 3.0 percent niobium, from about 2.6 percent to about 4.4 percent titanium, from about 2.6 percent to about 4.6 percent aluminum, from about 0.02 percent to about 0.10 percent carbon, from about 0.02 percent to about 0.04 percent boron, balance nickel and minor amounts of impurities.

18. The composition of matter of claim 17, wherein the composition of matter consists essentially of, in weight percent, about 20.4 percent cobalt, from about 10.3 percent to about 14 percent chromium, about 2.4 percent tantalum, from about 1.9 percent to about 4.0 percent tungsten, from about 1.9 percent to about 3.9 percent molybdenum, from about 0.04 percent to about 0.06 percent zirconium, from about 0.9 percent to about 3.0 percent niobium, about 3.6 percent titanium, about 3.6 percent aluminum from about 0.02 percent to about 0.10 percent carbon, from about 0.02 percent to about 0.04 percent boron, balance nickel and minor amounts of impurities.

* * * * *